US009490537B2

(12) United States Patent
Ito

(10) Patent No.: US 9,490,537 B2
(45) Date of Patent: Nov. 8, 2016

(54) ANTENNA DEVICE AND ELECTRONIC APPARATUS

(71) Applicant: MURATA MANUFACTURING CO., LTD., Kyoto (JP)

(72) Inventor: Hiromitsu Ito, Kyoto (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 115 days.

(21) Appl. No.: 14/246,899

(22) Filed: Apr. 7, 2014

(65) Prior Publication Data

US 2014/0218261 A1 Aug. 7, 2014

Related U.S. Application Data

(63) Continuation of application No. PCT/JP2012/077550, filed on Oct. 25, 2012.

(30) Foreign Application Priority Data

Nov. 9, 2011 (JP) ..... 2011-245380

(51) Int. Cl.

| | |
|---|---|
| ***H01Q 1/36*** | (2006.01) |
| ***H01Q 7/00*** | (2006.01) |
| ***H01Q 7/06*** | (2006.01) |
| ***H01Q 1/22*** | (2006.01) |

(52) U.S. Cl.

CPC ..... *H01Q 7/00* (2013.01); *H01Q 1/2225* (2013.01); *H01Q 7/06* (2013.01)

(58) Field of Classification Search

CPC ..... H01Q 1/2225; H01Q 7/00
USPC ..... 343/702, 866, 741, 895
See application file for complete search history.

(56) References Cited

U.S. PATENT DOCUMENTS

| | | | | |
|---|---|---|---|---|
| 5,945,958 | A | 8/1999 | Staufer et al. | |
| 6,075,706 | A | 6/2000 | Learmonth et al. | |
| 6,452,563 | B1 * | 9/2002 | Porte | H01Q 7/00 343/742 |
| 7,050,007 | B2 | 5/2006 | Akiho et al. | |
| 7,712,672 | B2 * | 5/2010 | Takahashi | G06K 7/10336 235/492 |
| 9,000,619 | B2 * | 4/2015 | Kato | H01Q 1/38 307/104 |

(Continued)

FOREIGN PATENT DOCUMENTS

| | | | |
|---|---|---|---|
| CN | 1300528 | A | 6/2001 |
| CN | 101882711 | A | 11/2010 |

(Continued)

OTHER PUBLICATIONS

International Search Report; PCT/JP2012/077550; Jan. 29, 2013.

(Continued)

*Primary Examiner* — Hoanganh Le
(74) *Attorney, Agent, or Firm* — Studebaker & Brackett PC

(57) ABSTRACT

An antenna device includes an antenna coil, a magnetic sheet, and a metallic member. The antenna coil is formed on a flexible base. The antenna coil is wound into a loop or a spiral in which a winding central portion is a coil opening portion. The magnetic sheet is disposed at a back surface of the flexible base. A square opening is formed in the metallic member. The antenna coil is exposed from the opening of the metallic member. A first side of the antenna coil is hidden by the metallic member and part of the coil opening portion and a second side are exposed from the opening, so that a magnetic flux links with the second side.

10 Claims, 12 Drawing Sheets

(56) References Cited

U.S. PATENT DOCUMENTS

| | | | | |
|---|---|---|---|---|
| 2011/0031320 | A1* | 2/2011 | Kato | G06K 19/07749 235/492 |
| 2011/0227799 | A1 | 9/2011 | Hashimoto | |
| 2012/0098711 | A1 | 4/2012 | Yosui et al. | |
| 2013/0300622 | A1 | 11/2013 | Kato et al. | |
| 2015/0171509 | A1 | 6/2015 | Kato et al. | |

FOREIGN PATENT DOCUMENTS

| | | | |
|---|---|---|---|
| EP | 2372840 | A2 | 10/2011 |
| EP | 2424041 | A1 | 2/2012 |
| JP | 10-84215 | | 3/1998 |
| JP | 2003-046319 | A | 2/2003 |
| JP | 2004-164547 | A | 6/2004 |
| JP | 2004-364199 | A | 12/2004 |
| JP | 2006085552 | A | 3/2006 |
| JP | 2006-270681 | A | 10/2006 |
| JP | 2006-351714 | A | 12/2006 |
| JP | 2008-167190 | A | 7/2008 |
| JP | 2009021970 | A | 1/2009 |
| JP | 2010-219916 | A | 9/2010 |
| JP | 4626413 | B2 | 2/2011 |
| JP | 2011-103702 | A | 5/2011 |
| JP | 4687832 | B2 | 5/2011 |
| JP | 2011-199343 | A | 10/2011 |
| JP | 4885093 | B2 | 2/2012 |
| WO | 2011/036962 | A1 | 3/2011 |

OTHER PUBLICATIONS

Written Opinion of the International Searching Authority; PCT/JP2012/077550; Jan. 29, 2013.

The First Office Action issued by the State Intellectual Property Office of People's Republic of China on Dec. 8, 2014, which corresponds to Chinese Patent Application No. 201280045626.3 and is related to U.S. Appl. No. 14/246,899; with English language translation.

An Office Action; Notice of Reasons for Rejection; issued by the Japanese Patent Office on Oct. 27, 2015 which corresponds to Japanese Patent Application No. 2015-000039 and is related to U.S. Appl. No. 14/246,899; with English language translation.

* cited by examiner

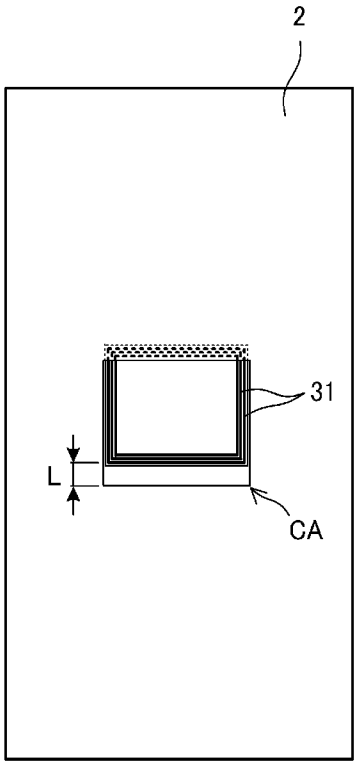
FIG. 2 ( C )
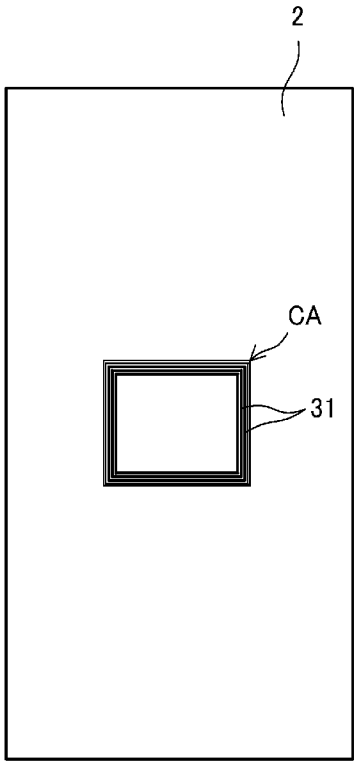
FIG. 2 ( B )
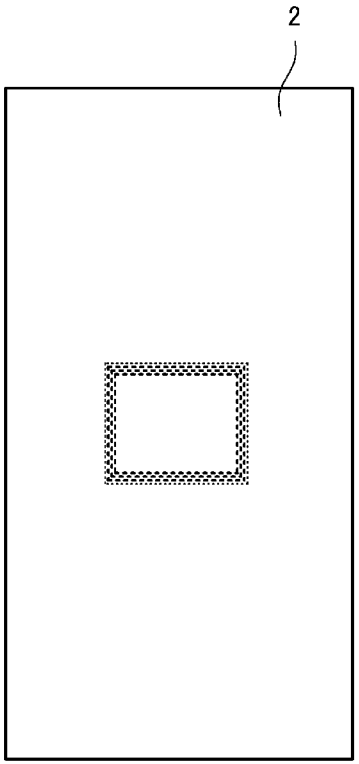
FIG. 2 ( A )

ANTENNA DEVICE AND ELECTRONIC APPARATUS

CROSS REFERENCE TO RELATED APPLICATIONS

This application claims benefit of priority to Japanese Patent Application No. 2011-245380 filed on Nov. 9, 2011, and to International Patent Application No. PCT/JP2012/077550 filed on Oct. 25, 2012, the entire content of each of which is incorporated herein by reference.

TECHNICAL FIELD

The present technical field relates to an antenna device used in a near field communication system or an RFID system that communicates with another apparatus via electromagnetic signals; and to an electronic apparatus including the antenna device.

BACKGROUND

In recent years, in systems that perform noncontact communication such as RFID systems and near field communication systems that are increasingly being used, in order to perform communication between portable electronic apparatuses, such as cellular phones, or between a portable electronic apparatus and a reader/writer, a communication antenna is installed in these apparatuses.

When such a noncontact communication antenna is installed at a back side of a metallic member, a magnetic field is intercepted by the metallic member. Therefore, it is not possible to perform communication with, for example, a reader/writer that is disposed on a side of the metallic member that is opposite to a side where the antenna is disposed.

An antenna device in which an antenna coil is disposed at a back side of a metallic member and a conductor opening is provided in the metallic member is disclosed in Japanese Patent No. 4687832.

FIG. 19(A) is a back view of an electronic apparatus including the antenna device in Japanese Patent No. 4687832. A back side of the electronic apparatus is the side that is caused to face a reader/writer antenna with which communication is performed. FIG. 19(B) is a plan view of an inner side of a lower-portion housing at the back side.

As shown in FIG. 19(A), a conductor layer 22 is formed at an outer surface of the lower-portion housing 1. The conductor layer 22 is, for example, a metalized film of aluminum or the like. An opening CA is formed in the conductor layer 22. In addition, a slit SL is formed consecutively between the opening CA and an outer edge. As shown in FIG. 19(B), an antenna coil module 3 is disposed at an inner surface of the lower-portion housing 1 so as to partly overlap the opening CA.

As another example, Japanese Patent No. 4626413 discloses a structure in which an antenna coil is disposed at an end portion of a communication terminal and communication is possible from both the front and back of the communication terminal.

SUMMARY

Technical Problem

In the antenna device described in Japanese Patent No. 4687832, since it is necessary to provide a slit in the metallic member, it cannot be applied to the case in which a metallic member having a simple shape is provided. In addition, when a metallic member that is a structural member is used, if a slit is formed along with the opening, the structural strength of the electronic apparatus including the antenna device is impaired. Further, when a metallic member that is a heat-dissipating member is used, if a slit is formed along with the opening, its heat-dissipation may be reduced.

In the structure of the antenna device described in Japanese Patent No. 4626413, the degree of design freedom is low when disposing the coil in an electronic apparatus.

Accordingly, it is an object of the present disclosure to provide an antenna device in which an antenna coil is disposed at a back side of a metallic member, an opening required for the metallic member is small, and stable communication can be performed with another device that exists on an opposite side of the metallic member; and an electronic apparatus including the antenna device.

Solution to Problem

An antenna device according to the present disclosure includes an antenna coil and a metallic member, wherein the antenna coil is wound into a loop or a spiral in which a winding central portion is a coil opening portion, the antenna coil including a first portion and a second portion opposing the first portion, wherein the metallic member is disposed so as to cover part of the antenna coil, wherein the metallic member has an opening, and wherein, as viewed in a direction perpendicular to the opening of the metallic member, the first portion of the antenna coil is not exposed from the opening of the metallic member, and at least part of the coil opening portion and the second portion of the antenna coil are exposed from the opening of the metallic member.

An electronic apparatus according to the present disclosure includes the antenna device, wherein the metallic member is provided as part of a housing.

Advantageous Effects of Disclosure

According to the present disclosure, magnetic flux that enters from the opening of the metallic member effectively links with the antenna coil, and is strongly coupled with an antenna device with which communication is performed. Therefore, it is possible for an opening that is formed in the metallic member to be small, and to perform stable communication with the device.

BRIEF DESCRIPTION OF THE DRAWINGS

FIGS. 2(A) and 2(B) show models of two antenna devices for comparison. FIG. 2(C) shows a model for determining characteristics of the antenna device 101 according to the first embodiment by simulation.

DETAILED DESCRIPTION

First Embodiment

An antenna device 101 according to a first embodiment is described with reference to FIGS. 1 to 3.

Figure 1A:
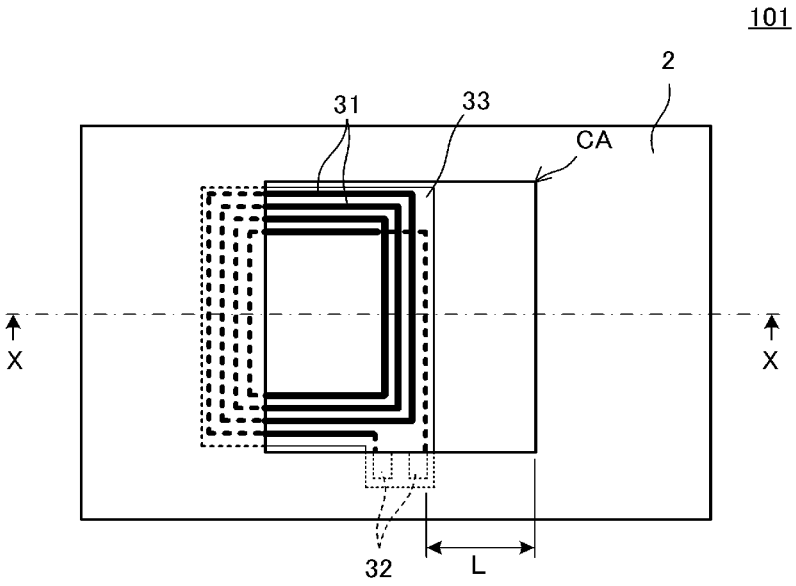
FIG. 1(A) is a plan view of an antenna device 101 according to a first embodiment.
Figure 1B:
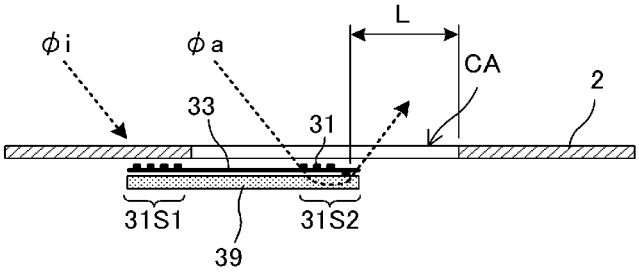
FIG. 1(B) is a sectional view of a portion along X-X in FIG. 1(A).

FIG. 1(A) is a plan view of the antenna device 101 according to the first embodiment, and FIG. 1(B) is a sectional view of a portion along X-X in FIG. 1(A). However, FIGS. 1(A) and 1(B) show only a structure of a main portion.

The antenna device 101 includes an antenna coil 31, a magnetic sheet 39, and a metallic member 2. The antenna coil 31 is formed on a flexible base 33. The antenna coil 31 is wound into a loop or a spiral in which a winding central portion is a coil opening portion. Both ends of the antenna coil 31 are taken out as connection portions 32. Although not illustrated in detail, for example, portions of conductors of the antenna coil 31 that overlap each other are formed over both surfaces of the flexible base 33 via via holes provided in the flexible base 33.

The magnetic sheet 39 is disposed at a lower surface of the flexible substrate 33.

As shown in FIGS. 1(A) and 1(B), the metallic member 2 is disposed so as to cover part of the antenna coil 31, and a square opening CA is formed in the metallic member 2 such that part of the antenna coil 31 is exposed from the opening CA of the metallic member 2.

The flexible base 33 is, for example, a polyimide film. The antenna coil 31 is, for example, a patterned copper foil. The magnetic sheet 39 is, for example, a ferrite sheet. The metallic member 2 is, for example, an aluminum plate, and is a heat-dissipating frame, part of a housing of an electronic apparatus, or the like.

The antenna coil 31 includes a first side 31S1, which is a first portion, and a second side 31S2, which is a second portion opposing the first side 31S1. In this embodiment, the antenna coil 31 is disposed close to the opening CA of the metallic member 2 while the first side 31S1 of the antenna coil 31 is hidden by the metallic plate 2 and part of the coil opening portion and the second side 31S2 are exposed from the opening CA. An outer edge of the second side 31S2 of the antenna coil 31 and an inner edge of the opening CA are separated from each other by a distance L.

In FIG. 1(B), broken arrows $\phi a$ and $\phi i$ denote magnetic fluxes that exit from an antenna of a reader/writer with which communication is performed. Since the second side 31S2 of the antenna coil 31 is exposed from the opening CA of the metallic member 2, the magnetic flux $\phi a$ links with the second side 31S2. In contrast, since the first side 31S1 of the antenna coil 31 is hidden by the metallic member 2, the magnetic flux $\phi i$ does not link with the first side 31S1. If both magnetic fluxes $\phi a$ and $\phi i$ link with the antenna coil 31, the direction of current that is generated in the antenna coil 31 by the magnetic flux $\phi a$ and the direction of current that is generated in the antenna coil 31 by the magnetic flux $\phi i$ are opposite each other, and cancel out. Therefore, the antenna coil 31 no longer functions as an antenna. In the embodiment, since the magnetic flux $\phi i$ does not substantially link with the antenna coil 31, the currents do not cancel out, so that the antenna coil 31 functions as an antenna that magnetically couples with the antenna of the reader/writer with which communication is performed.

For example, connection pins protruding from a circuit board in an electronic apparatus contact and are electrically connected with the connection portions 32 of the antenna coil 31.

The circuit board is provided with a capacitor that is connected in parallel with the connection portions 32. Resonance frequency is determined by capacitance of the capacitor and inductance determined by the antenna coil 31 and the magnetic sheet 39. When, for example, an HF band of a center frequency of 13.56 MHz is used, the resonance frequency is set at 13.56 MHz. However, the resonance frequency when the antenna coil 31 and the magnetic sheet 39 are not close to the metallic member 2 is previously set lower than the center frequency of use frequency bandwidth. When the antenna coil 31 is close to the metallic member 2, the inductance value of the antenna coil 31 becomes small. Therefore, the resonance frequency of the antenna device 101 is increased. Consequently, the antenna device 101 only needs to be designed so that, with the antenna device 101 being incorporated in an electronic apparatus, the resonance frequency of the antenna device 101 is substantially the same as the center frequency of use frequency bandwidth.

It is possible to form the antenna coil 31 on both surfaces of the flexible base 33 and use, as the capacitor, stray capacitance that is generated between the conductors of the antenna coil 31 at both surfaces. In this case, it is possible to reduce the number of parts because a separate capacitor does not need to be provided.

FIG. 2(C) shows a model for determining characteristics of the antenna device 101 according to the first embodiment by simulation. However, the dimension ratio of the parts differs from that in the embodiment shown in FIG. 1. FIGS. 2(A) and 2(B) show models of two antenna devices for comparison. In FIG. 2(B), a magnetic sheet is disposed at the back surface of a flexible base on which a spiral antenna coil is formed. In FIG. 2(A), the antenna coil and the magnetic sheet of the type shown in FIG. 2(B) are provided, and an opening CA is not formed in the metallic member 2.

The dimensions of the parts of the model are as follows.

Size of Opening CA: 25.9 mm×20.1 mm

Width of Antenna Coil Formation Region: 2.9 mm

Number of Turns of Antenna Coil: 6 turns

Pitch of Conductor Pattern of Antenna Coil: 0.5 mm (line width of 0.4 mm, line interval of 0.1 mm)

Outer Size of Antenna Coil: 25.5 mm×19.7 mm

Outer Size of Magnetic Sheet: 25.5 mm×19.7 mm

Figure 3:
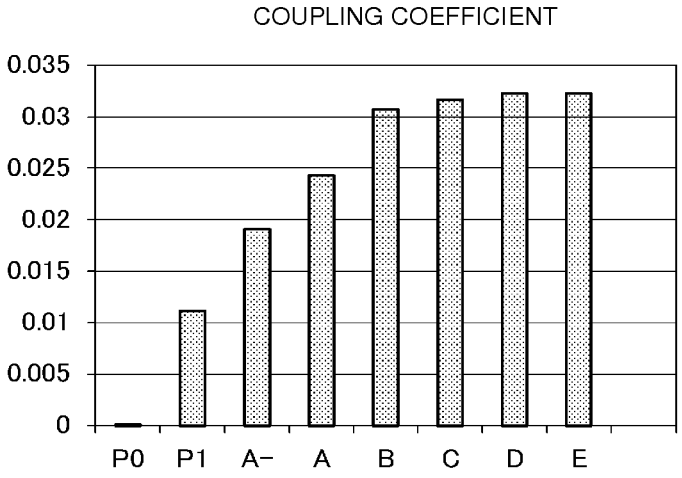
FIG. 3 shows a coupling coefficient of each of the antenna devices shown in FIGS. 2(A), 2(B) and 2(C).

Interval Between Antenna Coil and Metallic Member in Thickness Direction: 0.1 mm FIG. 3 shows coupling coefficient of each of the antenna devices shown in FIGS. 2(A), 2(B) and 2(C). "A-" to "E" in FIG. 3 are coupling coefficients when the distance L from the outer edge of the second side 31S2 of the antenna coil 31 to the inner edge of the opening CA is changed in the antenna device shown in FIG. 2(C), "P1" is the coupling coefficient of the antenna device shown in FIG. 2(B), and "P0" is the coupling coefficient of the antenna device shown in FIG. 2(A).

In FIG. 3, the relationships between A- to E and the distance L are as follows.

A-: L=1 mm

A: L=2 mm

B: L=4 mm

C: L=6 mm

D: L=8 mm

E: L=10 mm

The antenna device with which communication is performed includes an antenna coil that is formed so that its diameter is 70 mm, the number of turns of coil is 4 turns, the coil line width is 1.5 mm, and the line interval is 0.3 mm. A maximum value of the coupling coefficient was determined from a position that is separated by 25 mm in a vertical direction of the metallic member 2 and where the metallic member 2 and the antenna coil of the antenna device with which communication is performed are parallel to each other.

If an opening CA is not formed in the metallic member 2, there is no coupling as indicated by "P0" in FIG. 3. In the antenna device for comparison shown in FIG. 2(B), the entire spiral antenna coil is disposed at a surface of the magnetic sheet. Therefore, even if the opening CA is formed in the metallic member 2, magnetic flux links with each portion of the antenna coil (such as the first portion and the second portion opposing the first portion of the antenna coil), as a result of which currents that are generated at the portions of the antenna coil cancel out. Thus, as indicated by "P1" in FIG. 3, a high coupling coefficient cannot be obtained. In contrast, according to the antenna device of the first embodiment of the present disclosure, as indicated by "A-" to "E" in FIG. 3, coupling coefficients that are higher than that of the antenna device for comparison shown in FIG. 2(B) can be obtained. In addition, it can be understood that, until the position of the antenna coil 31 becomes a position where the second side 31S2 of the antenna coil 31 substantially passes the center of the opening CA (the position of the antenna coil 31 indicated by "D" in FIG. 3), the larger the distance L, the larger the coupling coefficient.

Second Embodiment

An antenna device 102 according to a second embodiment is described with reference to FIGS. 4 and 5.

Figure 4A:
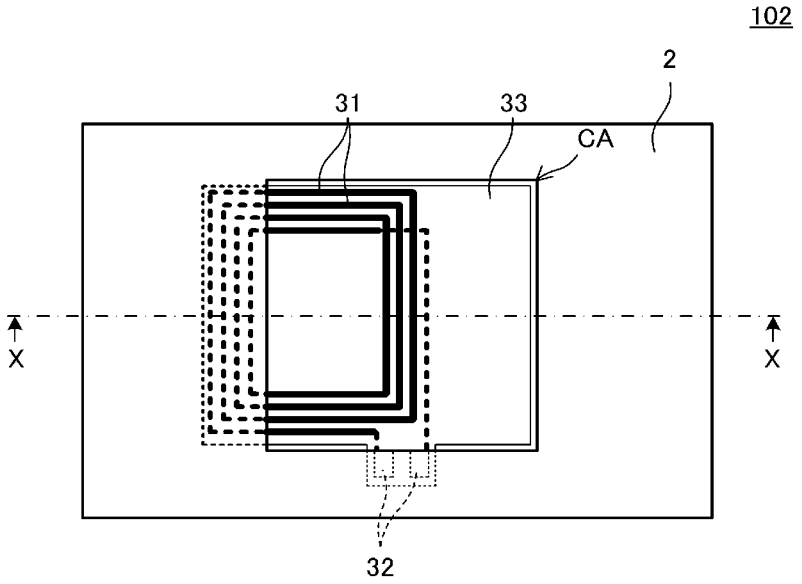
FIG. 4(A) is a plan view of an antenna device 102 according to a second embodiment.
Figure 4B:
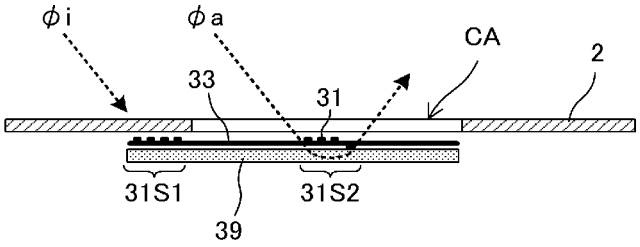
FIG. 4(B) is a sectional view of a portion along X-X in FIG. 4(A).

FIG. 4(A) is a plan view of the antenna device 102 according to the second embodiment, and FIG. 4(B) is a sectional view of a portion along X-X in FIG. 4(A). However, FIGS. 4(A) and 4(B) show only a structure of a main portion.

The antenna device 102 includes an antenna coil 31, a magnetic sheet 39, and a metallic member 2. The antenna coil 31 is formed on a flexible base 33. The antenna coil 31 is wound into a loop or a spiral in which a winding central portion is a coil opening portion.

The structures of the antenna coil 31, the magnetic sheet 39, and the metallic member 2 are the same as those of the first embodiment. The difference is the shape of the magnetic sheet 39. In the second embodiment, the magnetic sheet 39 is disposed so as to extend over substantially the entire region of an inner side of the opening CA as viewed in a direction perpendicular to an opening CA of the metallic member 2 (in plan view).

Figure 5:
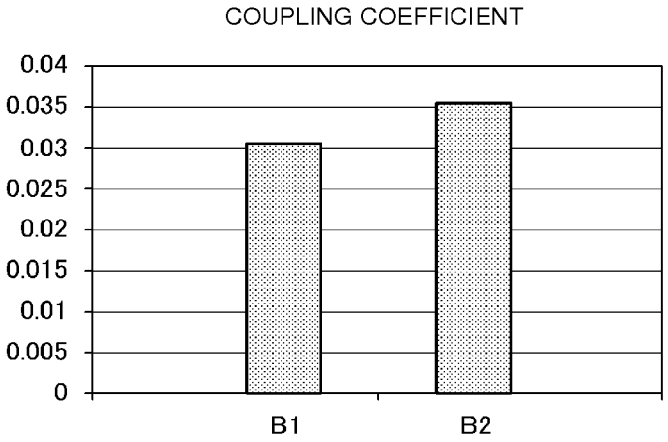
FIG. 5 shows a graph in which a coupling coefficient of the antenna device according to the second embodiment is determined by simulation.

FIG. 5 shows a graph in which coupling coefficient of the antenna device according to the second embodiment is determined by simulation. "B1" in FIG. 5 denotes the characteristic of the antenna 101 indicated by "B" in FIG. 3 among the characteristics in the first embodiment, and "B2" denotes the characteristics of the antenna device 102 according to the second embodiment. The conditions for determining the coupling coefficient are the same as those in the first embodiment.

As is clear from FIG. 5, when the magnetic sheet 39 is disposed so as to extend over substantially the entire region of the inner side of the opening CA, the amount of magnetic flux that links with the inside and outside of the coil opening portion of the antenna coil is increased, so that the coupling coefficient is further increased.

Third Embodiment

Figure 6A:
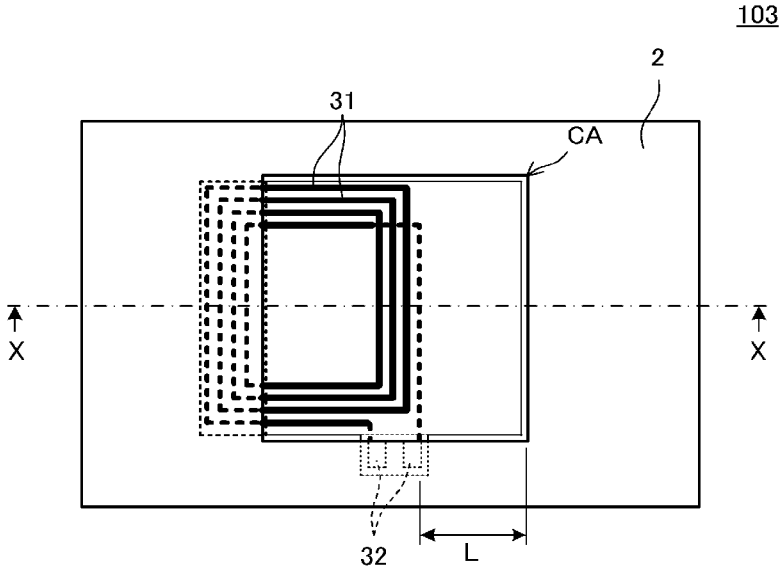
FIG. 6(A) is a plan view of an antenna device 103 according to a third embodiment.
Figure 6B:
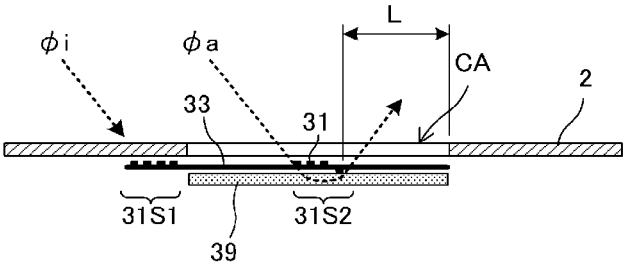
FIG. 6(B) is a sectional view of a portion along X-X in FIG. 6(A).

FIG. 6(A) is a plan view of an antenna device 103 according to a third embodiment, and FIG. 6(B) is a sectional view of a portion along X-X in FIG. 6(A). However, FIGS. 6(A) and 6(B) show only a structure of a main portion.

Unlike the antenna device 102 according to the second embodiment shown in FIG. 4, the antenna device 103 is such that a magnetic sheet 39 is only provided within an opening CA of a metallic plate 2 in plan view. The other structural features are the same as those of the antenna device 102 according to the second embodiment.

Figure 7:
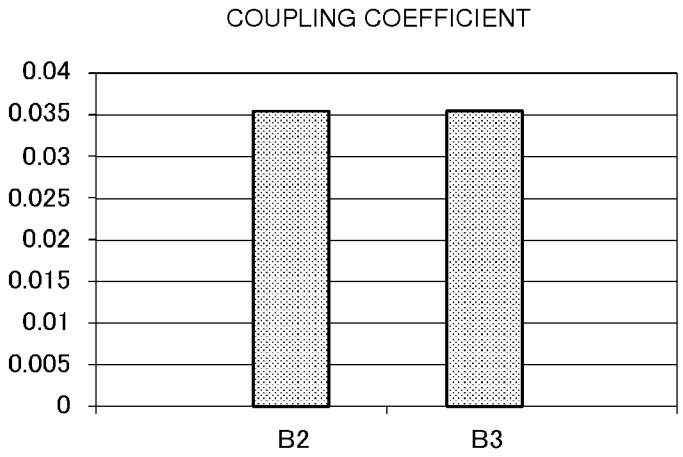
FIG. 7 shows a graph in which a coupling coefficient of the antenna device according to the third embodiment is determined by simulation.

FIG. 7 shows a graph in which coupling coefficient of the antenna device according to the third embodiment is determined by simulation. "B2" in FIG. 7 denotes the characteristics of the antenna device 102 according to the second embodiment, and "B3" denotes the characteristics of the antenna device 103 according to the third embodiment. The conditions for determining the coupling coefficient are the same as those in the first embodiment.

In this way, even if the magnetic sheet 39 does not extend at portions protruding from the opening CA, the coupling coefficients are almost the same. Therefore, if the magnetic sheet 39 is provided only within the opening CA of the metallic member 2 in plan view, it is possible to minimize the size of the magnetic sheet and to reduce costs.

Figure 8:
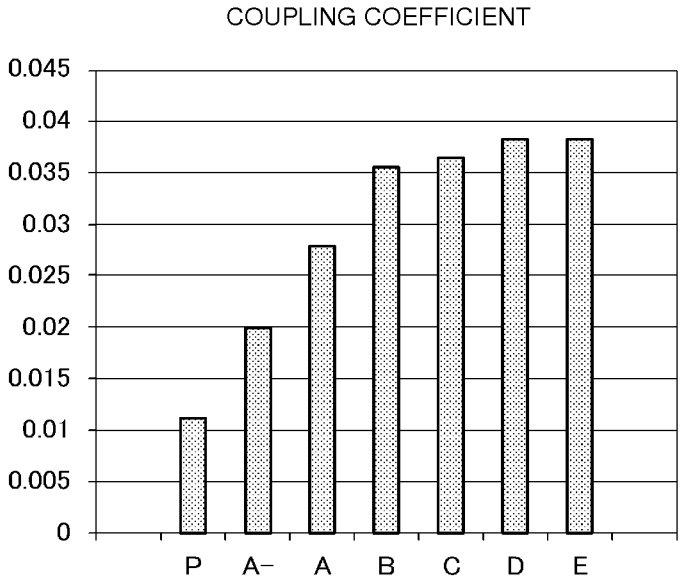
FIG. 8 shows a graph showing changes in the coupling coefficient when, in the antenna device according to the third embodiment, a distance L from a second side 31S2 of an antenna coil 31 to an inner edge of an opening CA is changed.

FIG. 8 shows a graph showing changes in the coupling coefficient when, in the antenna device according to the third embodiment, the distance L from a second side 31S2 of an antenna coil 31 to an inner edge of an opening CA is changed.

"A-" to "E" in FIG. 8 are coupling coefficients when, in the antenna device shown in FIG. 6, the distance L from an outer edge of the second side 31S2 of the antenna coil 31 to the inner edge of the opening CA is changed. "P" denotes the coupling coefficient of the antenna device shown in FIG. 2(B), which is a comparative example.

In FIG. 8, the relationships between A- to E and the distance L are as follows.

A-: L=1 mm
A: L=2 mm
B: L=4 mm
C: L=6 mm
D: L=8 mm
E: L=10 mm

The conditions for determining the coupling coefficient are the same as those in the first embodiment.

As is clear from FIG. 8, it can be understood that, until the position of the antenna coil 31 becomes a position where the second side 31S2 of the antenna coil 31 substantially passes the center of the opening CA (the position of the antenna coil 31 indicated by "D" in FIG. 8), the larger the distance L, the larger the coupling coefficient.

Fourth Embodiment

Figure 9A:
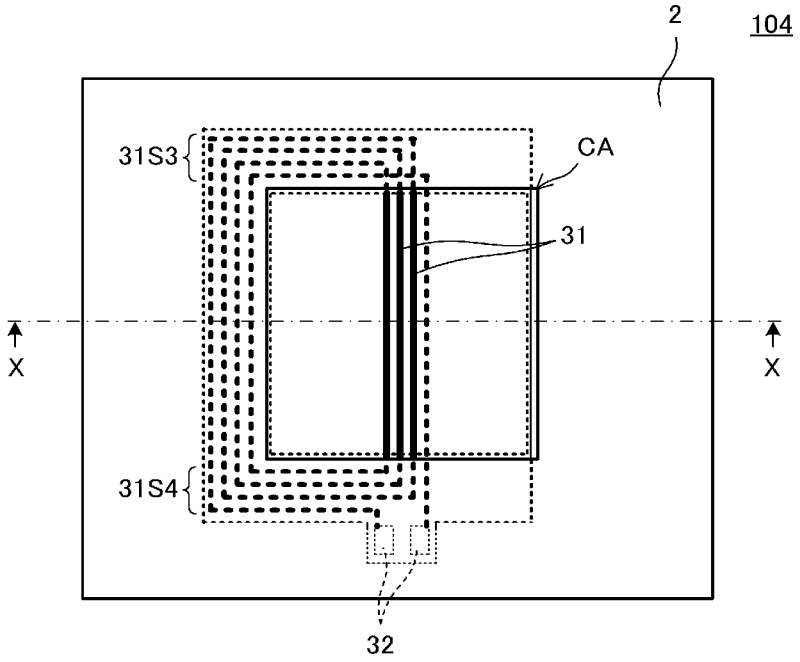
FIG. 9(A) is a plan view of an antenna device 104 according to a fourth embodiment.
Figure 9B:
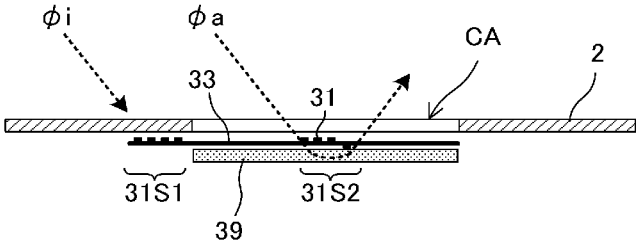
FIG. 9(B) is a sectional view of a portion along X-X in FIG. 9(A).

FIG. 9(A) is a plan view of an antenna device 104 according to a fourth embodiment, and FIG. 9(B) is a sectional view of a portion along X-X in FIG. 9(A). However, FIGS. 9(A) and 9(B) show only a structure of a main portion.

Unlike the antenna device 103 according to the third embodiment shown in FIG. 6, the antenna device 104 is such that only a second side 31S2 of the antenna coil 31 is exposed from an opening CA in plan view. That is, a third side 31S3 and a fourth side 31S4 that connect a first side 31S1 and the second side 31S2, and the first side 31S1 are disposed at the outer side of the opening CA and are hidden by a metallic member 2. More specifically, the dimensions of the first side 31S1 and the second side 31S2 of the antenna device indicated by "D" in FIG. 8 are made long, and the third side 31S3 and the fourth side 31S4 are hidden by the metallic member 2. The other structural features are the same as those of the antenna device 102 according to the second embodiment.

Figure 10:
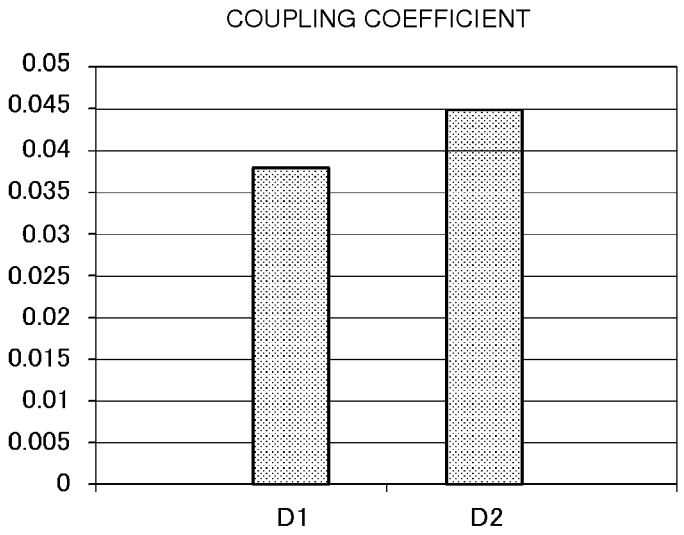
FIG. 10 shows a graph in which a coupling coefficient of the antenna device according to the fourth embodiment is determined by simulation.

FIG. 10 shows a graph in which coupling coefficient of the antenna device according to the fourth embodiment is determined by simulation. "D1" in FIG. 10 denotes the characteristic of the antenna device 103 according to the third embodiment (characteristic of the antenna device indicated by "D" in FIG. 8), and "D2" denotes the characteristics of the antenna device 104 according to the fourth embodiment. The conditions for determining the coupling coefficient are the same as those in the first embodiment.

It can be understood that, when only the second side 31S2 with which magnetic flux effectively links is exposed in the opening CA in this way, the coupling coefficient is further increased.

Fifth Embodiment

Figure 11A:
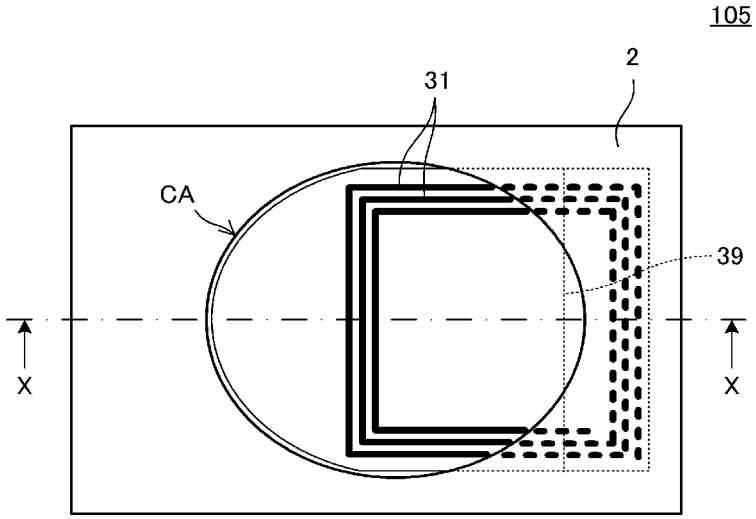
FIG. 11(A) is a plan view of an antenna device 105 according to a fifth embodiment.
Figure 11B:
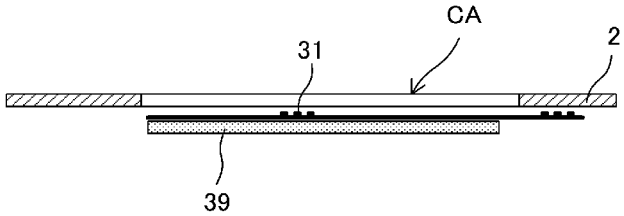
FIG. 11(B) is a sectional view of a portion along X-X in FIG. 11(A).

FIG. 11(A) is a plan view of an antenna device 105 according to a fifth embodiment, and FIG. 11(B) is a sectional view of a portion along X-X in FIG. 11(A). Unlike the antenna devices according to the embodiments above, an opening CA of a metallic member 2 that the antenna device 105 includes is nonrectangular. In this embodiment, the opening CA has an elliptical shape. Since the opening CA only needs to be a window that transmits magnetic flux, the opening CA may have a nonrectangular shape.

Sixth Embodiment

Figure 12:
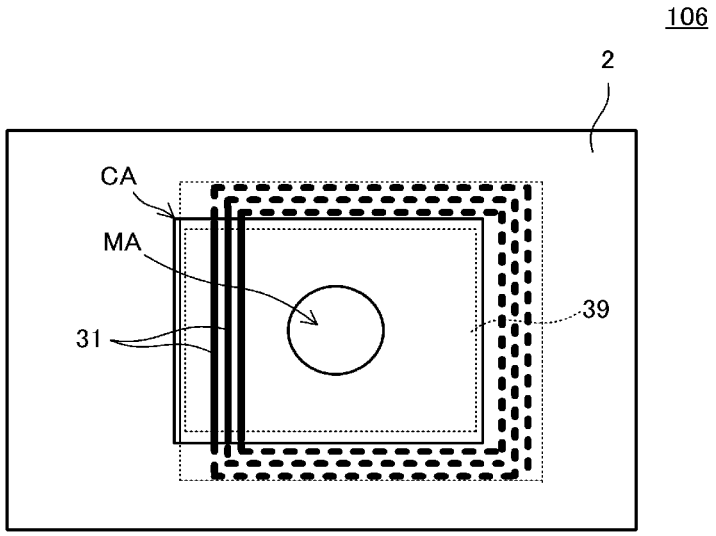
FIG. 12 is a plan view of an antenna device 106 according to a sixth embodiment.

FIG. 12 is a plan view of an antenna device 106 according to a sixth embodiment. Unlike the antenna devices according to the embodiments above, a magnetic sheet 39 that the antenna device 106 includes has a hole MA. This structure is effective for the case in which a camera module is built in a housing of an electronic apparatus and a lens of the camera module is exposed from an opening CA of a metallic member 2. That is, the hole MA of the magnetic sheet 39 can be used as an image pickup window of the camera module or as a cylinder for inserting the lens of the camera module.

Seventh Embodiment

Figure 13:
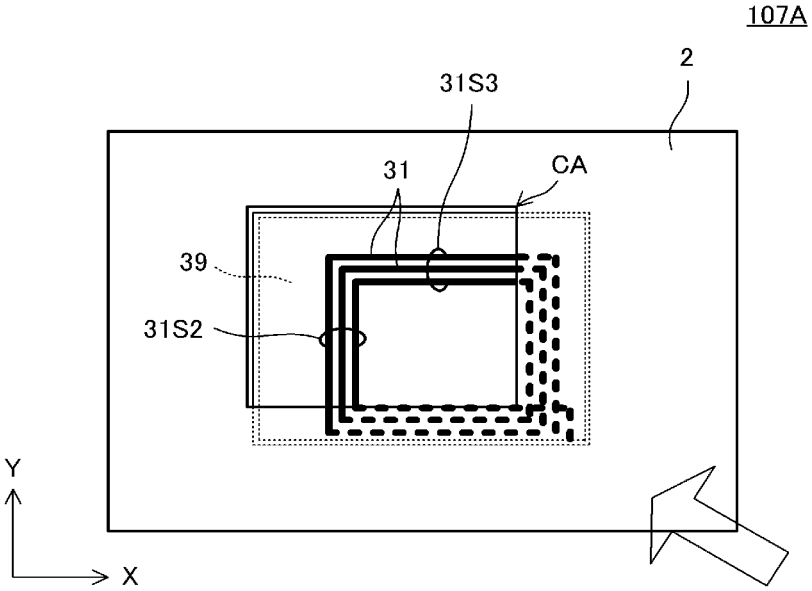
FIG. 13 is a plan view of an antenna device 107A according to a seventh embodiment.

FIG. 13 is a plan view of an antenna device 107A according to a seventh embodiment. Unlike the antenna devices according to the embodiments above, an antenna coil 31 that the antenna device 107A includes is such that an opening CA of a metallic member 2 includes two axes (X axis and a Y axis) that are orthogonal to each other, a winding center of the antenna coil 31 is displaced from the center of the opening CA in directions of the two axes, two adjacent sides of the antenna coil 31 and part of a coil opening portion are exposed from the opening CA, and the remaining two sides are not exposed.

Therefore, among portions of the antenna coil 31, not only a second side 31S2, but also a third side 31S3 acts as an effective magnetic flux linkage portion, the third side 31S3 being one of conductor portions that are parallel to a direction of insertion (axial direction) of a magnetic sheet 39. As a result, an orientation direction of the antenna is inclined, and the antenna is oriented in the direction of the arrow in FIG. 13. Accordingly, in this way, it is possible to control the directivity by the direction of displacement of the antenna coil 31.

Figure 14:
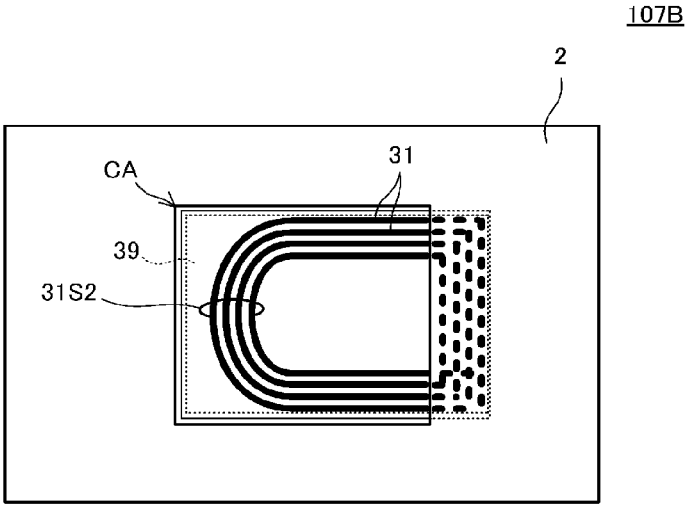
FIG. 14 is a plan view of a different antenna device 107B according to the seventh embodiment.

FIG. 14 is a plan view of a different antenna device 107B according to the seventh embodiment. Unlike the antenna devices according to the embodiments above, a second side 31S2 of an antenna coil 31 that the antenna device 107B includes is curved.

Since the antenna coil 31 only needs to include an effective magnetic flux linkage portion, part of the antenna coil 31 or the entire antenna coil 31 may have a curved portion.

Eighth Embodiment

In an eighth embodiment, mounting structures of antenna devices that electronic apparatuses include and structures of the electronic apparatuses are described.

Figure 15:
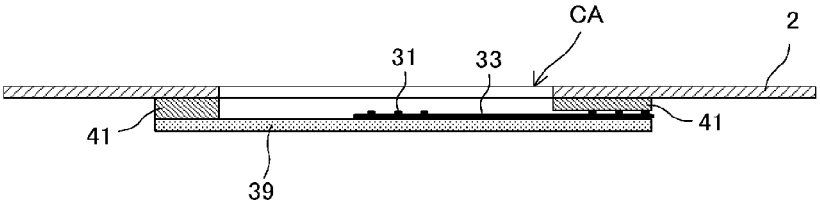
FIG. 15 is a sectional view of an antenna device provided at an electronic apparatus according to an eighth embodiment.
Figure 16:
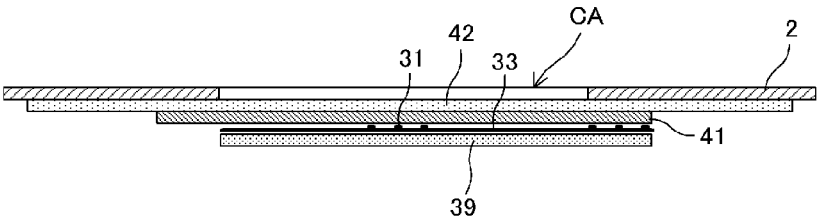
FIG. 16 is a sectional view of a different antenna device provided at an electronic apparatus according to the eighth embodiment.

FIGS. 15 and 16 are each a sectional view of the antenna device provided at the corresponding electronic apparatus. In the example shown in FIG. 15, an outer peripheral portion of a magnetic sheet 39 is bonded to an outer peripheral portion of an opening CA of a metallic member via an adhesive (such as a two-sided tape) 41. In the example shown in FIG. 16, an antenna module including a magnetic sheet 39 and a flexible base 33 on which an antenna coil is formed is bonded to a resin sheet 42 using an adhesive (such as a two-sided tape) 41, and the resin sheet 42 is bonded to a surrounding portion of an opening CA of a metallic member 2. In this way, each structural member including the metallic member 2 is integrated to each other.

Ninth Embodiment

In a ninth embodiment, a mounting structure of an antenna device that is not integrated to a metallic member 2 and a structure of an electronic apparatus are described.

Figure 17:
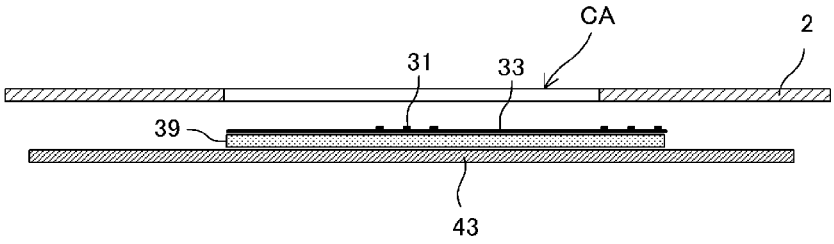
FIG. 17 is a sectional view of an antenna device provided at an electronic apparatus according to a ninth embodiment.

FIG. 17 is a sectional view of the antenna device provided at the electronic apparatus. In this embodiment, an antenna module including a magnetic sheet 39 and a flexible base 33 on which an antenna coil is formed is mounted on a printed wiring board 43. A metallic member 2 is part of a housing of the electronic apparatus. By accommodating the printed wiring board 43 in the housing, the antenna module opposes the opening CA.

In this way, the metallic member 2 and the antenna module may be separately provided.

Tenth Embodiment

In a tenth embodiment, a special structure for feeding power to an antenna coil 31 and a structure of an electronic apparatus are described.

Figure 18:
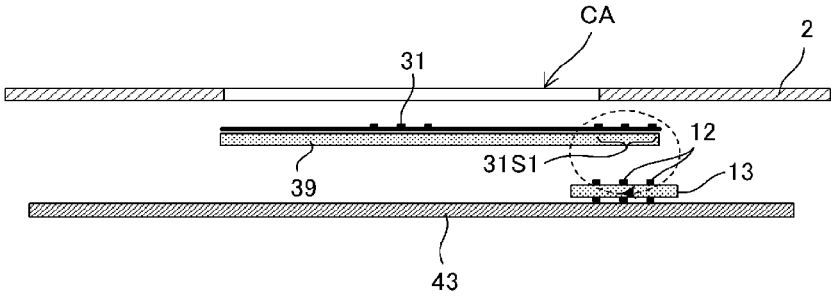
FIG. 18 is a sectional view of an antenna device provided at an electronic apparatus according to a tenth embodiment.
Figure 19A:
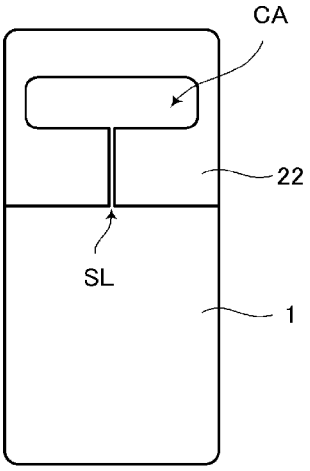
FIG. 19(A) PRIOR ART
FIG. 19(A) is a back view of the electronic apparatus including the antenna device of Japanese Patent No. 4687832.
Figure 19B:
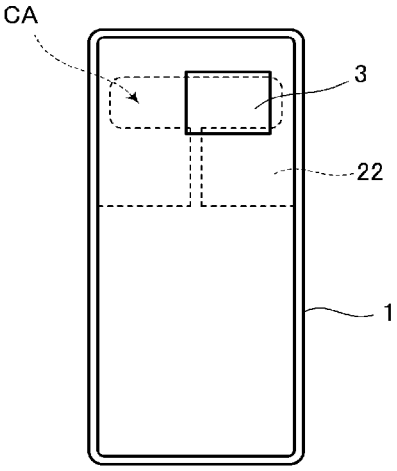
FIG. 19(B) PRIOR ART
FIG. 19(B) is a plan view of the inner side of the lower-portion housing at the back side of the electronic apparatus.

FIG. 18 is a sectional view of an antenna device provided at the electronic apparatus. In FIG. 18, a power feeding module including an excitation coil 12 and a magnetic core 13 is mounted on a printed circuit board 43. The excitation coil 12 is wound around the magnetic core 13 in a left-right direction shown in FIG. 18 defined as a winding axis. The magnetic core 13 of the power feeding module is close to a first side 31S1 of the antenna coil 31. The magnetic core 13 and the first side 31S1 are electromagnetically (primarily, magnetically) coupled with each other.

The antenna coil 31 has basically the same structure as the antenna coils of the antenna devices that have been described thus far. However, the antenna coil 31 does not have connection portions 32, and an LC parallel resonance circuit is formed using the antenna coil 31. A capacitance component of the LC parallel resonance circuit is a capacitance that is generated between conductor patterns of the antenna coil. In addition, if necessary, a capacitance electrode may be provided along with the antenna coil 31.

Other Embodiments

The metallic member according to the present disclosure is not limited to a metallic plate. For example, when part of an outer surface of a housing is made metallic in terms of design, a metallic film is formed on the outer surface of the housing by evaporation or the like, in which case the metallic film may be used as the metallic member.

The number of turns of the antenna coil 31 may be determined by the outside shape and required inductance. If the number of turns is one, the coil conductors are simply loop-shaped coil conductors.

Although the magnetic sheet 39 functions as an effective member for efficiently linking magnetic flux with the antenna coil 31, the magnetic sheet 39 does not need to be provided.

The invention claimed is:

1. An antenna device comprising an antenna coil and a metallic member, the antenna coil being wound into a loop or a spiral in which a winding central portion is a coil opening portion, the antenna coil including a first portion and a second portion opposing the first portion which are positioned at opposite sides of the coil opening portion, the metallic member being disposed so as to cover part of the antenna coil, the metallic member having an opening, and wherein, as viewed in a direction perpendicular to the opening of the metallic member, the first portion of the antenna coil is not exposed from the opening of the metallic member, and at least part of the coil opening portion and the second portion of the antenna coil are exposed from the opening of the metallic member, wherein a center of the coil opening portion is deviated from a center of the opening of the metallic member in plan view in the direction perpendicular to the opening of the metallic member.

2. The antenna device according to claim 1, wherein, as viewed in the direction perpendicular to the opening of the metallic member, a magnetic sheet that extends over substantially an entire region of an inner side of the opening is disposed along the antenna coil.

3. The antenna device according to claim 2, wherein the magnetic sheet is disposed in a range in which the magnetic sheet does not protrude outward from the inner side of the opening as viewed in the direction perpendicular to the opening of the metallic member.

4. The antenna device according to claim 1, wherein the second portion of the antenna coil is disposed so as to pass the center or a vicinity of the center of the opening as viewed in the direction perpendicular to the opening of the metallic member.

5. The antenna device according to any claim 1, wherein only the second portion of the antenna coil is exposed from the opening as viewed in the direction perpendicular to the opening of the metallic member.

6. The antenna device according to claim 1, wherein a hole is formed in a magnetic sheet within the coil opening portion as viewed in the direction perpendicular to the opening of the metallic member.

7. The antenna device according to claim 1, wherein the antenna coil includes a curved portion.

8. The antenna device according to claim 1, wherein the opening of the metallic member includes two axes that are orthogonal to each other, and a winding center of the antenna coil is displaced from the center of the opening in directions of the two axes.

9. An antenna device comprising the antenna coil according to claim 1, a magnetic sheet, and a metallic member, wherein the antenna coil forms at least part of a resonance circuit, and wherein an excitation coil that electromagnetically couples with the antenna coil is provided.

10. An electronic apparatus comprising the antenna device according to claim 1 and a housing, wherein the metallic member is part of the housing.

* * * * *